US010989464B2

(12) United States Patent
Dalmolin

(10) Patent No.: US 10,989,464 B2
(45) Date of Patent: *Apr. 27, 2021

(54) SYSTEM, METHOD, AND APPARATUS FOR MONITORING REFRIGERATION UNITS

(71) Applicant: Guido Dalmolin, Clermont, FL (US)

(72) Inventor: Guido Dalmolin, Clermont, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/827,803

(22) Filed: Mar. 24, 2020

(65) Prior Publication Data

US 2020/0224961 A1 Jul. 16, 2020

Related U.S. Application Data

(63) Continuation-in-part of application No. 15/782,852, filed on Oct. 13, 2017, now Pat. No. 10,641,532.

(60) Provisional application No. 62/535,138, filed on Jul. 20, 2017.

(51) Int. Cl.

| | |
|---|---|
| ***F25B 49/02*** | (2006.01) |
| ***F25D 29/00*** | (2006.01) |
| ***F25B 49/00*** | (2006.01) |

(52) U.S. Cl.

CPC ..... *F25D 29/008* (2013.01); *F25B 49/005* (2013.01); *F25B 2500/08* (2013.01); *F25B 2700/2104* (2013.01); *F25D 2700/02* (2013.01); *F25D 2700/12* (2013.01)

(58) Field of Classification Search

CPC ..... F25D 2700/02; F25B 49/005

See application file for complete search history.

(56) References Cited

U.S. PATENT DOCUMENTS

| | | | | |
|---|---|---|---|---|
| 5,533,349 | A | 7/1996 | Gromala | |
| 6,927,871 | B1 | 8/2005 | Silverbrook | |
| 7,150,156 | B2 | 12/2006 | Gatling | |
| 7,728,711 | B2 | 6/2010 | Shoenfeld | |
| 9,513,043 | B2 | 12/2016 | Keres | |
| 10,641,532 | B2 * | 5/2020 | Dalmolin | F25B 49/022 |
| 10,677,484 | B2 * | 6/2020 | Ribbich | G05D 23/1934 |
| 2015/0268281 | A1 * | 9/2015 | Haghighat-Kashani | G06Q 30/0267 702/62 |

* cited by examiner

*Primary Examiner* — Elias Desta

(74) *Attorney, Agent, or Firm* — Larson & Larson, P.A.; Frank Liebenow; Justin P. Miller

(57) ABSTRACT

A system for monitoring and reporting internal refrigeration unit temperatures includes a temperature measuring device for placement within the refrigeration unit. The temperature measuring device has a first temperature sensors situated in a liquid or solid mass (e.g. glycol or glass beads) for measuring an average temperature within the refrigeration unit and/or has a second temperature sensors exposed to ambient air within the refrigeration unit for measuring an instantaneous temperature within the refrigeration unit. A circuit periodically transmits the average temperature and/or the instantaneous temperature from the temperature measuring device to a server where the average temperature and the instantaneous temperature are analyzed to determine and/or predict a fault with the refrigeration unit. Upon determination and/or prediction of the fault, an alert is sent to at least one staff member indicating the refrigeration unit and fault.

19 Claims, 7 Drawing Sheets

SYSTEM, METHOD, AND APPARATUS FOR MONITORING REFRIGERATION UNITS

CROSS-REFERENCE TO RELATED APPLICATION

This application is a continuation-in-part of U.S. patent application Ser. No. 15/782,852 filed on Oct. 13, 2017, now U.S. Pat. No. 10,641,532 issued May 5, 2020, which claims the benefit of U.S. provisional application No. 62/535,138 filed on Jul. 20, 2017, the disclosure of both are incorporated by reference.

FIELD

This invention relates to temperature monitoring and more particularly to a system for monitoring temperatures in refrigeration units, especially those used to store medications.

BACKGROUND

Federal programs such as the Vaccines for Children (VFC) program provide federally-funded vaccines to private pediatric practices via state agencies. The state agencies are responsible for collecting and monitoring temperature data provided by the private pediatric personnel.

Until recently, the data was often written down twice daily by office personnel and reviewed periodically by state health inspectors when they made routine inspection visits to the practice.

Very recently there has been an increasing awareness that these drugs are not being monitored sufficiently. There is a strong sense of urgency to ensure the drugs are still effective at the time they are administered to patients.

Several states are attempting to find better solutions address these problems. One State, in particular, has provided temperature logging devices to all the VFC pediatric practices within that State. The devices are attached to the refrigerators that contain the VFC vaccines and require the health care providers to remove the devices from the refrigerators on a weekly basis and connect them to USB docking stations attached to their office computers. Upon connection, the devices generate plain text files consisting of temperature and time data structured as columns delimited by commas or Comma Separated Value (CSV) files. These plain text files are then uploaded to the state VFC database. There are several obvious problems with this method. The CSV file can be manipulated prior to uploading to state or federal agencies and it is a never-ending tedious cycle that places additional burdens on office personnel. Additionally, the temperature is not being monitored for the duration of data acquisition using USB docking station and no data is available in the intervals between device docking. Thus, the data only identifies temperature problems several days after they have already occurred. If a problem is detected, the pediatric practice is financially responsible for replacing the entire stock of vaccines and drugs. A typical home-style refrigerator can easily store several hundred thousand dollars' worth of vaccines.

A mandate requiring continuous and automatic temperature monitoring with alarm reporting capabilities is inevitable. However, even before this mandate becomes effective, doctors and state officials are searching for reliable solutions to protect vaccines from damage due to poor temperature conditions. In order to enforce the safety procedures, officials must obtain uncompromised temperature data and not rely on data that can be manipulated or destroyed by the health care providers. In order for health care providers to respond to temperature problems before damage occurs, they must receive alert notifications and physically respond in a timely manner. Because life, health, and great financial costs are at risk, a secure audit trail of all temperature data, alert notifications, alert acknowledgements, and physical response confirmations is critical to ensure optimum safety and accountability. In some embodiments, a temperature graph is presented to staff before the staff acknowledges and/or signs a temperature inspection report. It forces them to view useful data and not a single numeric temperature which represents only a single moment in time During the normal operation of typical home-style refrigerators air temperatures fluctuate greatly when the compressors cycle on and off. Additionally, the air temperatures also fluctuate greatly when the doors are opened and closed. Because the process of monitoring temperature data by officials (and the logging of the data itself) was previously a manual hands-on process, it was very difficult to analyze this data in a manner that would indicate the true average temperature of the refrigerator and ultimately the vaccines.

For this reason, federal guidelines require that the temperature measuring devices are placed in a buffered solution such as propylene glycol. A bottle of glycol increases the physical mass of the temperature probe and ultimately slows down the response time providing a flatter, more stable temperature reading.

The obvious drawback of this method is a delayed detection of a genuine refrigeration system problem as the material will retain certain amounts of heat/cold for a period of time after refrigeration failure.

In addition to these temperature-detection shortcomings, all temperature alarm systems known to date simply send unconfirmed alert messages via SMS, email, or voice calls. No system known to date provides operator accountability by acknowledging that the alert messages are actually received by the intended recipient.

Furthermore, even if the recipient is known to have received the alert message, no system known to date confirms that a physical response procedure has been performed in a timely manner.

Other systems typically use the health-care provider's internet connectivity and will not operate when the internet or utilities fail. Some systems are cellular-only but none known to date operates in dual mode, using the provider's internet as a primary source, but only reverting to cellular when the primary connection fails.

What is needed is a system that will monitor temperatures within refrigeration units and provide reporting, alerts, and predictive analysis.

SUMMARY

A system and method to record and distribute temperature information that is collected from a temperature monitoring device is disclosed. The temperature monitoring device is designed to be placed directly inside refrigerators and freezers and provides real-time temperature and optionally lighting levels that are transmitted to a server. The server alerts when one or more temperature or refrigeration system events occur. These events include temperatures that either exceed or fall below pre-set warning or limit values, or when temperature trends are symptomatic of underlying refrigeration system faults are detected.

The system for temperature monitoring and alerting recognizes fault and trending conditions and provides real-time alert messages, confirmation of message receipt, and acknowledgements. The system for temperature monitoring and alerting also confirms that a physical on-site response has been performed. In some embodiments, failure to acknowledge an alert message or physically respond to the alert location in a timely manner results in a hierarchy of alert message escalations to additional personnel and management.

The system for temperature monitoring and alerting not only provides real-time glycol-based buffered temperature data required for regulatory agencies, but also monitors the air temperature within the refrigerator and/or freezers. Software running on a server processes the data received from the temperature measuring device and detects the normal on-off cycling of the refrigerators' compressors. Deviations from the "normal" on-off cycle pattern generate an alert message indicating that the compressors have either failed or are operating outside normal parameters. This failure detection solution provides a much faster detection of potential temperature problems as it detects when the compressor stops functioning instead of waiting for lagging indicators such as glycol-based or air temperatures to rise to critical levels, allowing for application of ice packs to preserve contents of the units.

In some embodiments, especially those in which there are no regulatory requirements for glycol-based buffered temperature data, the buffered temperature is calculated by averaging the ambient temperature within the refrigeration unit over time.

In some embodiments, the buffered temperature data (e.g. temperature measurements taken within a mass such as glycol or glass) is used to monitor the on/off cycles of the refrigeration unit over time and is used to predict failures and/or doors left open.

A significant rate-of-rise in temperature between normal compressor cycles is an indication that either a refrigeration unit door was opened, or that the refrigeration unit is in a defrost cycle. The significant rate-of-rise can serve to delay the alert messages for a specified period of time to allow for the normal compressor cycle pattern to resume.

In some embodiments, an ambient light sensor is used to detect when refrigerator and freezer doors are open. Software running on the server records such and temporarily allows irregular temperature patterns to occur during such operation without generating an alert.

In some embodiments, if light is detected for prolonged periods of time (specified by the user), the server generates alert messages indicating that a door has been left open.

In one embodiment, a system for monitoring and reporting internal refrigeration unit temperatures includes a temperature measuring device for placement within the refrigeration unit. The temperature measuring device has a first temperature sensors situated in a buffer (e.g., a solution or mass) for measuring an average temperature within the refrigeration unit and has a second temperature sensors exposed to ambient air within the refrigeration unit for measuring an instantaneous temperature within the refrigeration unit. A circuit periodically transmits the average temperature and the instantaneous temperature from the temperature measuring device to a server where the average temperature and the instantaneous temperature are analyzed to determine and/or predict a fault with the refrigeration unit. Upon determination and/or prediction of the fault, sending an alert is sent to at least one staff member indicating the refrigeration unit and fault.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
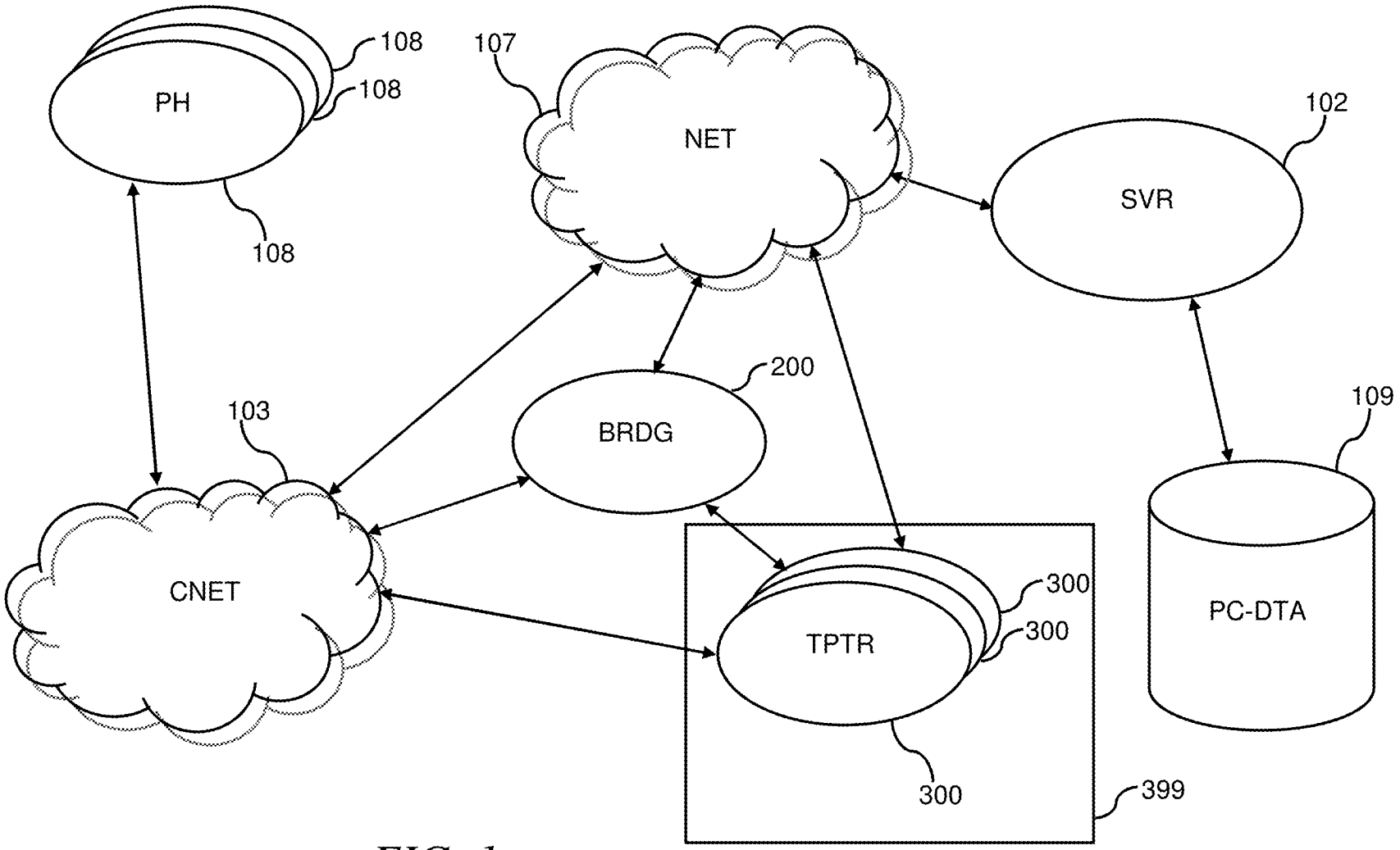
FIG. 1 illustrates a data connection diagram of the system for temperature monitoring and alerting.

Reference will now be made in detail to the presently preferred embodiments of the invention, examples of which are illustrated in the accompanying drawings. Throughout the following detailed description, the same reference numerals refer to the same elements in all figures.

In general, the system for temperature monitoring and alerting provides capabilities to measure temperatures and optionally light levels within a refrigeration unit, reporting such temperatures for various purposes such as recordation to comply with local/federal requirements for the storage of vaccines, etc. The system for temperature monitoring and alerting differentiates between a door remaining open (fast rise in temperature) and a failing compressor or power failure (slow rise in temperature), and reports such in alerts.

Referring to FIG. 1 illustrates a data connection diagram of the system for temperature monitoring and alerting. In this example, one or more remote devices such as cell phones 108 communicate through the cellular network 103 and/or through a wide area network 107 (e.g. the Internet) to a server computer 102.

The server computer 102 that is external to the refrigeration unit 399 has access to data storage 109 for storing various data, including historical temperature readings, etc. Although one path between the remote devices or cell phones 108 and the server 102 is through the cellular network 103 and the wide area network 107 as shown, any known data path is anticipated. For example, the Wi-Fi transceiver 96 (see FIG. 2) of the remote devices or cell phone 108 is used to communicate directly with the wide area network 107, which includes the Internet, and, consequently, with the server computer 102.

The server computer 102 transacts with the remote devices or cell phones 108 through the network(s) 103/107 to present menus to/on the remote devices or cell phones 108, provide data to the remote devices or cell phones 108, and to communicate information such as alerts to the remote devices or cell phones 108.

The server computer 102 transacts with applications running on the remote devices or cell phones 108 and/or with standardized applications (e.g., browsers) running on the user's remote devices or cell phones 108.

The system for temperature monitoring and alerting includes at least one temperature measuring device 300 located within the refrigeration unit 399. The temperature measuring devices 300 are battery-powered and transmit messages to either a bridge unit 200 that is external to the refrigeration unit 399 or directly to the server 102 that is also external to the refrigeration unit 399 through a wireless local area network or through the cellular network 103, in some embodiments through encrypted RF transmissions. As power consumption of the temperature measuring devices 300 is important, less power is required to communicate in a one-way, transmit only system with a bridge unit 200, though it is equally anticipated that the temperature measuring devices 300 communicate directly with the cellular network 103 or wide area network 107 through any wireless protocols such as 802.11 (Wi-Fi), Bluetooth, etc., either one-way or bi-directional transmission.

In one embodiment, the system for temperature monitoring and alerting records temperature data transmitted from a plurality of temperature measuring devices 300 via a wide area network 107 such as the internet to a server 102.

Figure 2:
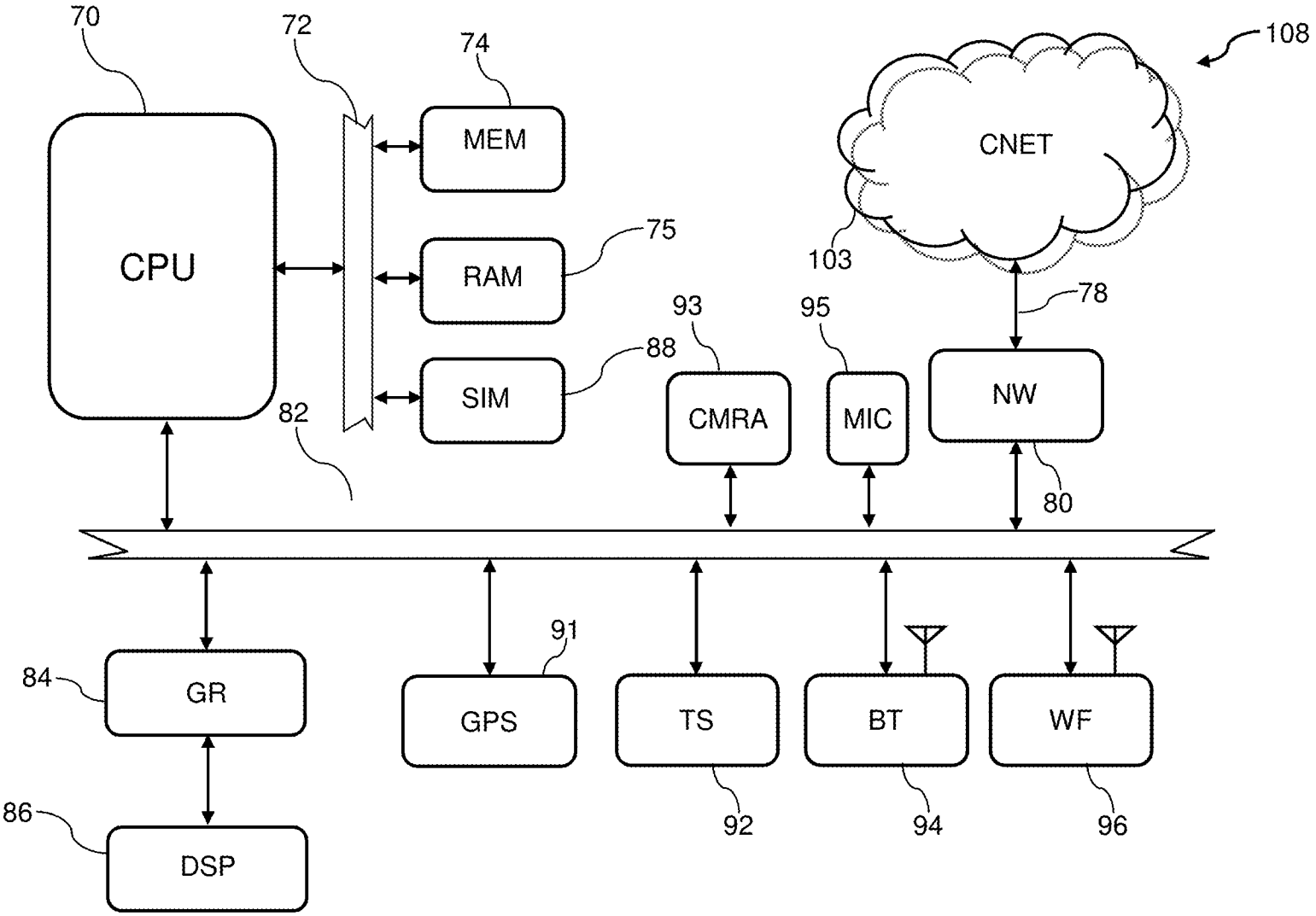
FIG. 2 illustrates a schematic view of a typical cell phone used in the system for temperature monitoring and alerting.

Referring to FIG. 2, a schematic view of a typical cell phone 108 is shown. The example cell phone 108 represents a typical phone system used for accessing user interfaces (e.g. see FIG. 4) of the system for temperature monitoring and alerting. This exemplary cell phone 108 is shown in a typical form. Different architectures are known that accomplish similar results in a similar fashion and the present invention is not limited in any way to any particular cell phone 108 system architecture or implementation. In this exemplary cell phone 108, a processor 70 executes or runs programs in a random access memory 75. The programs are generally stored within a persistent memory 74 and loaded into the random access memory 75 when needed. Also accessible by the processor 70 is a SIM card 88 (subscriber information module) having a subscriber identification and often persistent storage. The processor 70 is any processor, typically a processor designed for phones. The persistent memory 74, random access memory 75, and SIM card are connected to the processor by, for example, a memory bus 72. The random access memory 75 is any memory suitable for connection and operation with the selected processor 70, such as SRAM, DRAM, SDRAM, RDRAM, DDR, DDR-2, etc. The persistent memory 74 is any type, configuration, capacity of memory suitable for persistently storing data, for example, flash memory, read only memory, battery-backed memory, magnetic memory, etc. In some exemplary cell phones 10, the persistent memory 74 is removable, in the form of a memory card of appropriate format such as SD (secure digital) cards, micro SD cards, compact flash, etc.

Also connected to the processor 70 is a system bus 82 for connecting to peripheral subsystems such as a cellular network interface 80, a graphics adapter 84 and a touch screen interface 92. The graphics adapter 84 receives commands from the processor 70 and controls what is depicted on a display image on the display 86. The touch screen interface 92 provides navigation and selection features.

In general, some portion of the persistent memory 74 and/or the SIM card 88 is used to store programs, executable code, phone numbers, contacts, and data, etc. In some embodiments, other data is stored in the persistent memory 74 such as audio files, video files, text messages, etc.

The peripherals are examples and other devices are known in the industry such as Global Positioning Subsystem 91, speakers, microphones, USB interfaces, Bluetooth transceiver 94, Wi-Fi transceiver 96, camera 93, microphone 95, image sensors, temperature measuring devices, etc., the details of which are not shown for brevity and clarity reasons.

The cellular network interface 80 connects the cell phone 108 to the cellular network 103 through any cellular band and cellular protocol such as GSM, TDMA, LTE, etc., through a wireless medium 78. There is no limitation on the type of cellular connection used. The cellular network interface 80 provides voice call, data, and messaging services to the cell phone 108 through the cellular network.

For local communications, many cell phones 108 include a Bluetooth transceiver 94, a Wi-Fi transceiver 96, or both. Such features of cell phones 108 provide data communications between the cell phones 108 and data access points and/or other computers such as a the server 102.

Figure 3:
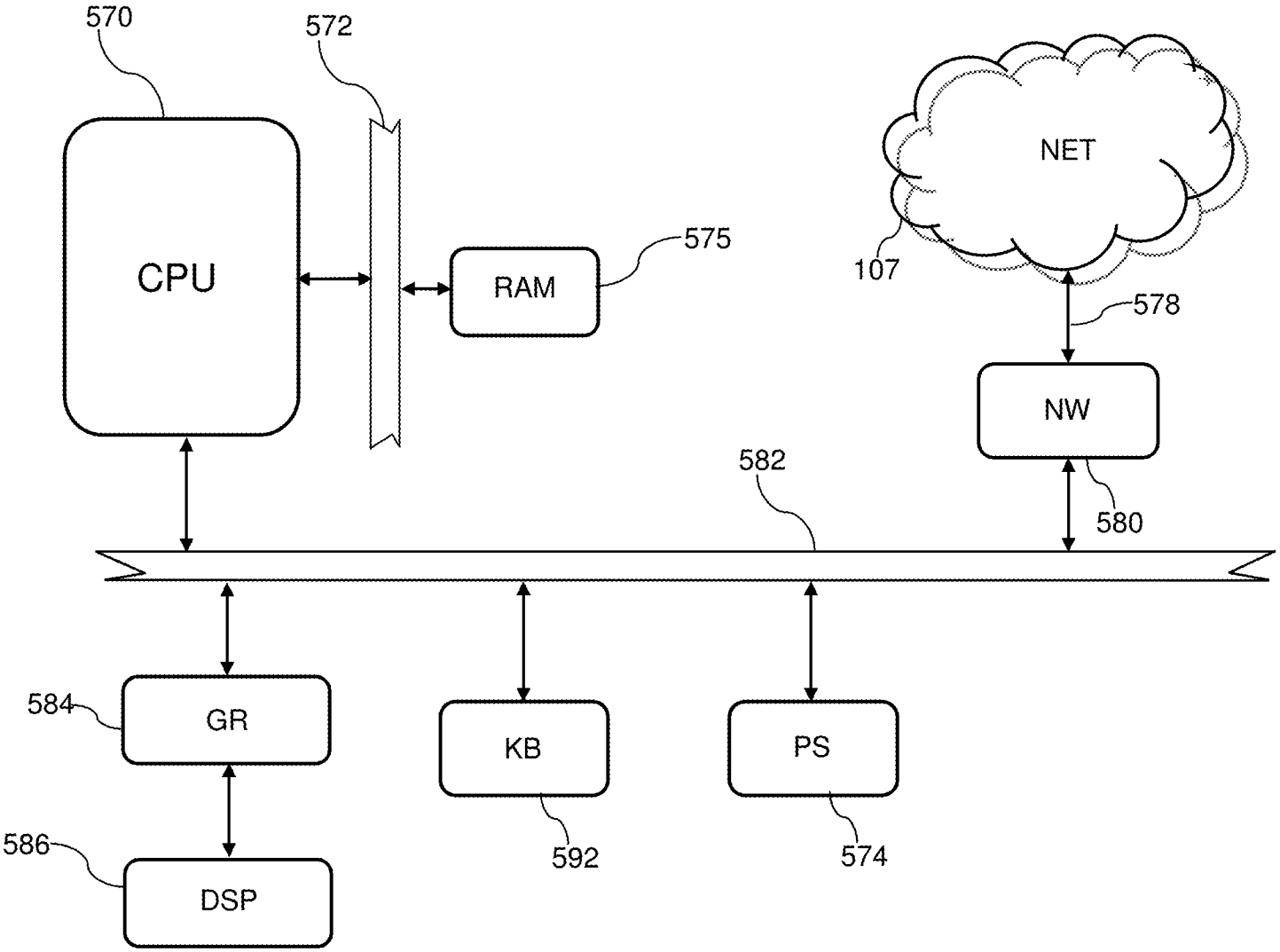
FIG. 3 illustrates a schematic view of a typical computer system such as a server or micro-controller.

Referring to FIG. 3, a schematic view of a typical computer (e.g., server 102 or bridge unit 200) is shown. The example computer system represents a typical computer system used for back-end processing, generating reports, displaying data, etc. This exemplary computer system is shown in its simplest form. Different architectures are known that accomplish similar results in a similar fashion and the present invention is not limited in any way to any particular computer system architecture or implementation. In this exemplary computer system, a processor 570 executes or runs programs in a random access memory 575. The programs are generally stored within a persistent memory 574 and loaded into the random access memory 575 when needed. The processor 570 is any processor, typically a processor designed for computer systems with any number of core processing elements, etc. The random access memory 575 is connected to the processor by, for example, a memory bus 572. The random access memory 575 is any memory suitable for connection and operation with the selected processor 570, such as SRAM, DRAM, SDRAM, RDRAM, DDR, DDR-2, etc. The persistent memory 574 is any type, configuration, capacity of memory suitable for persistently storing data, for example, magnetic storage, flash memory, read only memory, battery-backed memory, magnetic memory, etc. The persistent memory 574 is typically interfaced to the processor 570 through a system bus 582, or any other interface as known in the industry.

Also shown connected to the processor 570 through the system bus 582 is a network interface 580 (e.g., for connecting to a data network 107), a graphics adapter 584 and a keyboard interface 592 (e.g., Universal Serial Bus—USB). The graphics adapter 584 receives commands from the processor 570 and controls what is depicted on a display image on the display 586. The keyboard interface 592 provides navigation, data entry, and selection features.

In general, some portion of the persistent memory 574 is used to store programs, executable code, data, contacts, and other data, etc.

The peripherals are examples and other devices are known in the industry such as speakers, microphones, USB interfaces, Bluetooth transceivers, Wi-Fi transceivers, image sensors, temperature measuring devices, etc., the details of which are not shown for brevity and clarity reasons.

Figure 4:
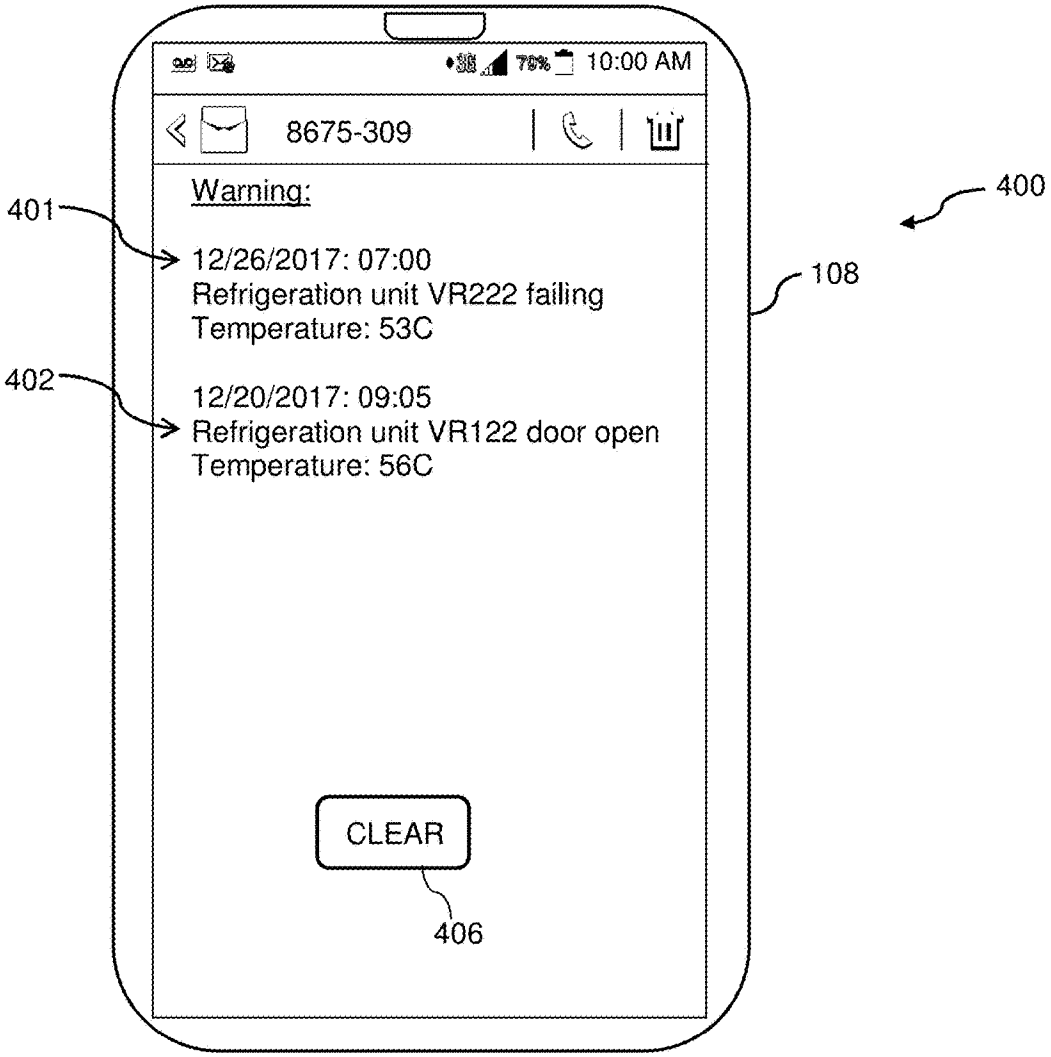
FIG. 4 illustrates an exemplary cell phone user interface of the system for temperature monitoring and alerting showing text alerts.

Referring to FIG. 4, an exemplary cell phone user interface of the system for temperature monitoring and alerting is shown. Although many user interfaces are anticipated, one example user interface is a text message interface 400 that is used to inform of issues related to one or more refrigeration units 399 (see FIGS. 5 and 6). The user interface 400 runs on a cellular phone 108 or other device. When the messaging application runs, for example, on the user's cell phone 108, the messaging application communicates with the server 102, receiving messages that include status and alerts. In this example, a first alert 401 has been received indicating that the refrigeration unit 399 (VR222) is failing, along with the current temperature of that unit (53 degrees C.) and the date/time of the alert (7:00 on 12/26/2017). Further in this example, a second alert 402 has been received indicating that another refrigeration unit 399 (VR122) has an open door, along with the current temperature of that unit (56 degrees C.) and the date/time of the alert (9:05 on 12/20/2017). In some embodiments, once the alert is tended to, a clear operation 406 is invoked.

Figure 5:
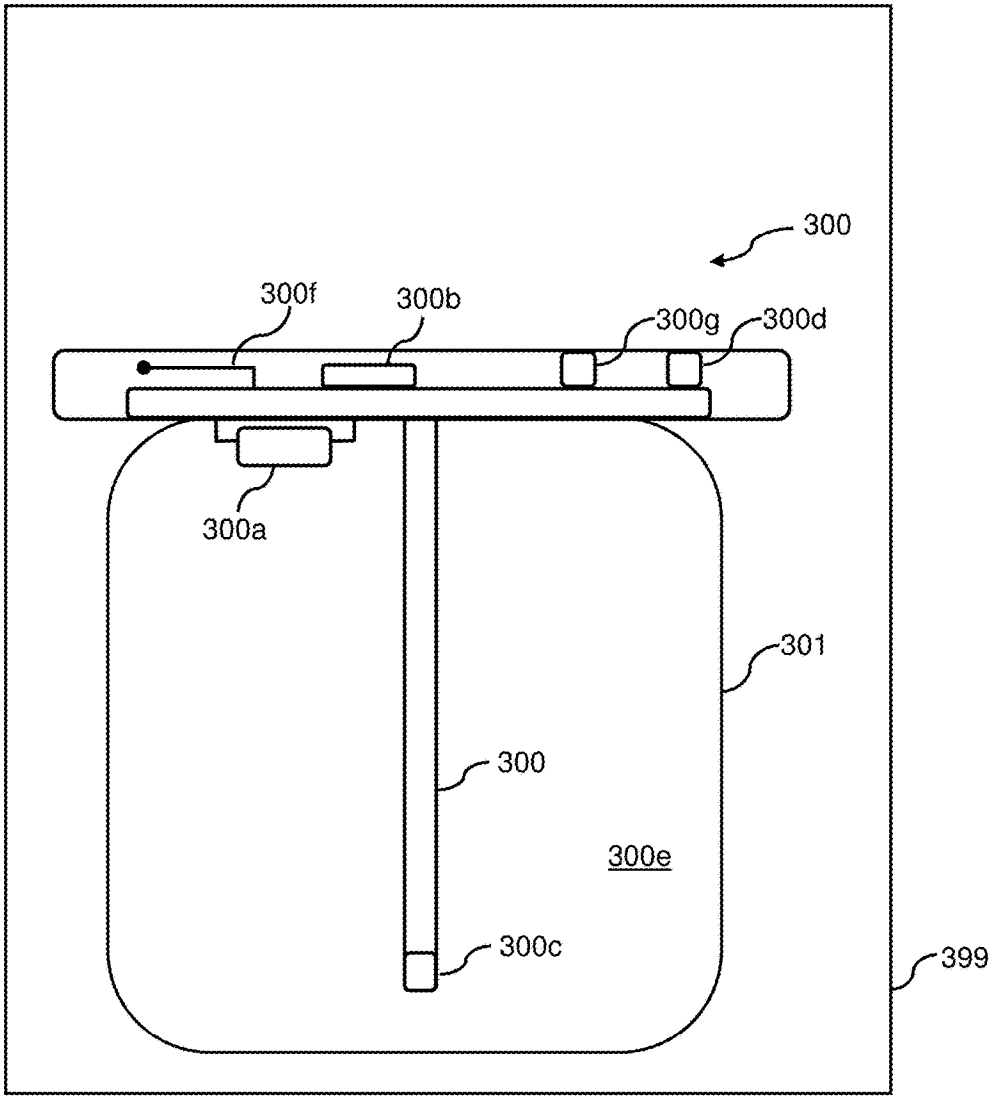
FIG. 5 illustrates a plan view of temperature sensing device of the system for temperature monitoring and alerting.
Figure 6:
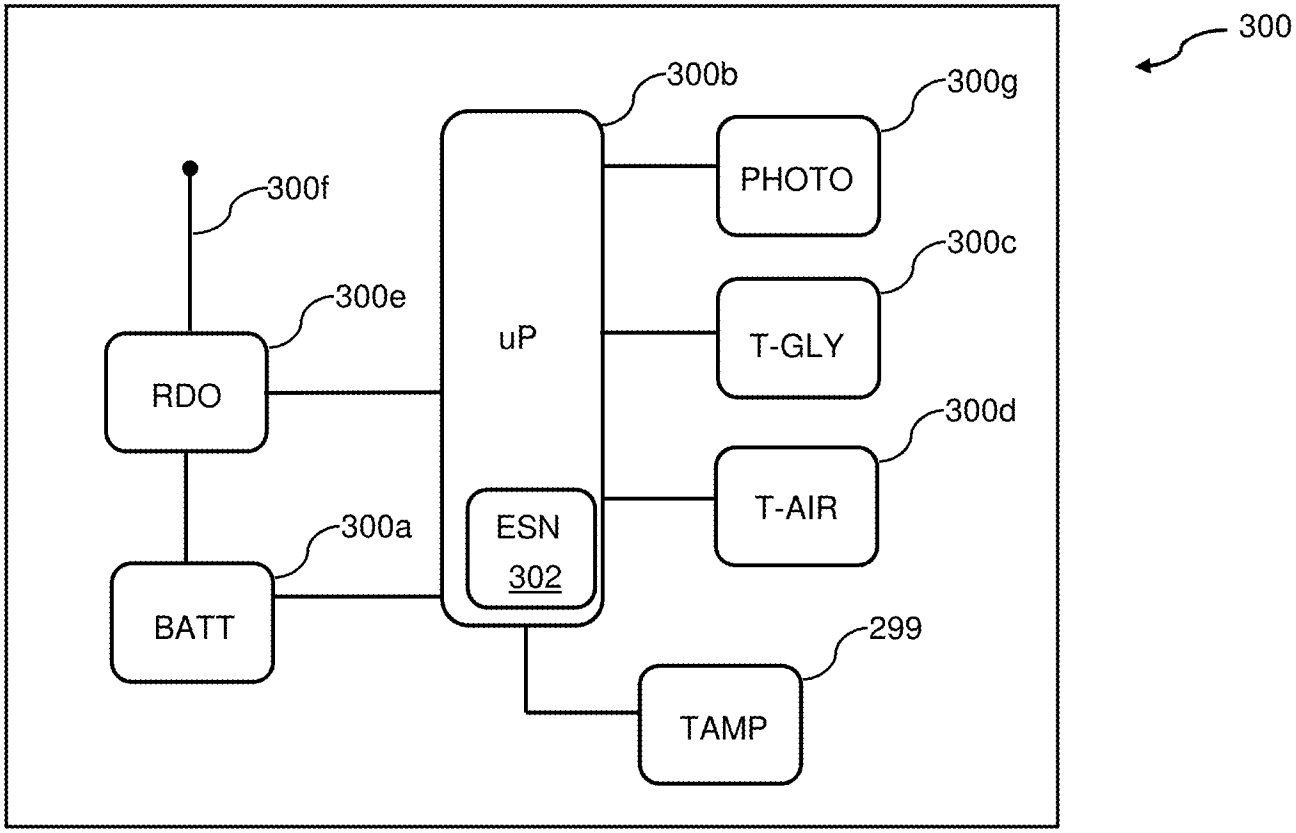
FIG. 6 illustrates block diagram of the temperature sensing device of the system for temperature monitoring and alerting.

Referring to FIGS. 5 and 6, examples of temperature measuring devices 300 are shown. The temperature measuring devices 300 are battery-powered and transmit messages to systems external to the refrigeration unit 399; either a bridge unit 200 or directly to the server 102 through a wireless local area network or through the cellular network 103, in some embodiments through encrypted RF transmissions. As power consumption of the temperature measuring devices 300 is important, less power is required to communicate in a one-way, transmit only system with a bridge unit 200, though it is equally anticipated that the temperature measuring devices 300 communicate directly with the cellular network 103 or wide area network 107 through any wireless protocols such as 802.11 (Wi-Fi), Bluetooth, etc.

To maximize life of the battery 300*a* used by the temperature measuring devices 300, it is anticipated that in some embodiments, the processor 300*b* within the temperature measuring device 300 remains in sleep mode most of the time. In such, when the processor 300*b* wakes up, preferably at factory-set intervals, the processor 300*b* samples the temperature of a first temperature probe 300*c* that is embedded/submerged in a mass of dense material, for example, glass beads or glycol. The mass (e.g. glass beads or glycol) is contained within a container 301. In some embodiments, the processor 300*b* samples the temperature of an ambient air temperature measuring probe 300*d*. In some embodiments, the processor 300*b* samples ambient light levels by reading a light sensor 300*g*.

Although the temperature measuring devices 300 is shown having two temperature probes 300*c*/300*d*, in some embodiments only a single temperature probe is present, for example, only the first temperature probe 300*c* that is submerged in, for example, glycol or glass beads; or only the ambient air temperature measuring probe 300*d*. In embodiments in which the first temperature probe 300*c* that is submerged in, for example, glycol is the only temperature probe present, the cycling pattern of the compressor of the refrigeration unit is derived by comparing instantaneous temperature readings from the first temperature probe 300*c* compared to an average of temperature readings from the first temperature probe 300*c*. In embodiments in which the ambient air temperature measuring probe 300*d* is the only temperature probe present, the buffered temperature is derived by averaging of temperature readings from the ambient air temperature measuring probe 300*d*.

In embodiments in which a bridge unit 200 is present, the micro-controller initiates an RF transmission to the bridge unit 200, including measurements from each sensor 300*c*/300*d*/300*g*. In some embodiments, the RF transmission is encrypted. The transmission includes the temperature data, optionally a factory-set electronic serial number 302 of the temperature measuring device 300, status of the battery 300*a*, and in some embodiments, status of a tamper switch 299.

In embodiments having a bridge unit 200, when the message is received by the bridge unit 200, the message is stored within a persistent memory 574 of the bridge unit 200 until the bridge unit 200 initiates a transmission to the server 102.

The server 102 stores various criteria such as high and low temperature set points for each temperature measuring device 300 within the data storage 109.

When the server 102 receives a message from a bridge unit 200, the temperature data from each temperature measuring device 300 is stored in a database/data storage 109.

Upon receipt of the data from one or more temperature measuring devices 300, the server 102 process the data received from each temperature measuring device 300 to determine whether or not an alert response is required.

If the received temperature data meets certain criteria, the server initiates a response to alert a user about this condition (see FIG. 4 for an example).

In some embodiments, the server 102 initiates an alert when a temperature measuring device 300 or bridge unit 200 fails to communicate to the server 102 for a predetermined amount of time.

In some embodiments, the server 102 initiates an alert when a temperature measuring device 300 or bridge unit 200 is tampered with or if a trouble condition exists, such as a low battery level within the temperature measuring device 300.

In most embodiments, alerts are sent to one or more cell phones 108 or any other user device, for example, in the form of a short-message-system message (SMS text) transmitted, for example, from the server 102 through the wide area network 107 through the cellular network 103 to one or more cell phones 108. In some embodiments, each alert is sent to an application running on a cell phone 108 and the application confirms reading of the alert as well as requests an acknowledgement to the alert. In some embodiments, the camera 93 of the cell phone 108 is used to capture and log proof of responses to an alert, for example, moving the medications to an ice chest or alternate refrigeration unit 399.

In some embodiments, alerts are sent to users via email messages sent from the server 102 through the wide area network 107.

In some embodiments, alerts are sent via voice over telephone calls from the server 102 to the subscriber's telephones 108 via automated voice messages from the server 102.

In some embodiments, alerts are sent from the server 102 to cell phones 108 via SMS or smartphone application running on the phones 108.

In some embodiments, each temperature measuring device 300 has a unique and separate set of alerts for each condition. For example, each temperature measuring device 300 has a serial number that is included in the alerts and/or is translated to a name (e.g. "refrigeration unit 1") and the name is included in the alert.

A typical alert includes sending an email and/or SMS message when a temperature measuring device 300 reads temperature rising above, or falling below temperature thresholds specified by the user for a particular temperature measuring device 300. In some embodiments, the user specifies how long the temperature reported by each temperature measuring device 300 need exceed the specified alert temperature thresholds before an alert is initiated. This time allows the temperature to exceed the specified temperature parameters for brief periods of time, such as when refrigerator doors are opened for brief periods of time. This delay period also eliminates false alarms during refrigeration defrost cycles.

It is anticipated that all settings and alerts are configurable by the subscriber, for example using a web-based software application running on the server 102. It is also anticipated that the user has access a temperature measuring device's 300 historical temperature data via the same web-based application on the server 102.

In one embodiment, software on the server 102 analyzes the temperature data received from a temperature measuring device 300 to determine whether or not the refrigeration system is functioning properly.

The temperature within a refrigerator or freezer is generally constantly changing. In almost all cases of normal refrigerator/freezer unit's operation, the units begin warming soon after the compressor stops and then begin cooling when the compressor restarts. When the refrigerator doors remain closed, the on/off cycling pattern of the compressor occurs at fairly regular and predictable intervals.

In many industries, it is possible that power to refrigeration units 399 is disconnected by accident. For example, in the food and restaurant industry, freezer power cords are accidentally removed during the shutdown or cleanup procedures at the closing time of the establishments. As another example, circuit breakers are un-intentionally switched off to refrigeration units 399 when personnel intend to turn off lighting and signage at closing.

Typically, when power is turned off to a refrigeration unit 399, it takes several hours for the temperatures to slowly rise to critical or near-critical levels before a problem is even detected. In the case of restaurants closing—many of which shutdown between 11 PM and 2 AM—by the time the temperature reaches a threshold, the alert is not delivered until the personnel have already gone home and are often sound asleep many hours after the problem was initially created.

It is therefore extremely desirable to detect when a compressor fails to operate in a minimal amount of time, as this provides very early warning of a temperature problem.

Although the cycle-rate of compressors vary among refrigeration units 399, they typical on/off cycle time ranges from 6 to 12 minutes.

The temperature data received by the server 102 is averaged over a specified time (e.g., 60 minutes).

When the temperature received rises above this average, or falls below this average temperature (e.g., allowing for a specified hysteresis value, typically of 0.25° F.) of a compressor cycle is validated as RISE CYCLE (in the case of the air rising above the average) and the compressor cycle is validated as a LOW CYCLE in the latter case where the temperature falls below the average temperature.

This averaging and hysteresis function is performed in software, either in the server 102 or processor 300*b* or, in some embodiments, this averaging and hysteresis function is performed in hardware of the temperature measuring device 300 using conventional analog operational amplifier circuits that employ an averaging technique comprised of a combination of a bias level and a time constant interval, for example, implemented using a voltage level proportional to the temperature and a timer that will expire when the zero-crossing pattern is not performed within a specified time period.

As federal requirements dictate the need to buffer a temperature probe, the temperature measuring device 300 includes two temperature probes. A first temperature probe 300*c* is submerged in a buffer or mass 300*e* (a solid such as glass beads or a solution e.g., glycol) so that the first temperature probe 300*c* reads the average temperature of the refrigeration unit 399.

As the buffer or mass 300*e* (e.g., solid or solution such as glycol) surrounding the first temperature probe 300*c* increases, so does the difficulty to detect small changes in the surrounding air temperature and the ability to analyze the compressor patterns. The temperature measuring device 300 includes a second temperature probe which is an ambient air temperature measuring probe 300*d* that is fluidly interfaced to ambient air around the temperature measuring device 300, for measuring instantaneous temperatures within the refrigeration unit 399 for analysis of the compressor cycle pattern and operation of the door to the refrigeration unit 399.

In one embodiment, real-time temperature data is transmitted to the server at a rate of once per minute as analyzing of the compressor cycling is more easily accomplished with server based software as opposed to on-board hardware and software, although it is equally anticipated that the analysis and tracking is performed at a local computing entity such as the bridge unit 200.

The Center for Disease Control (CDC) and many state health agencies either mandate or recommend the use of a buffer solution such as glycol bottle to "average" the air temperature data measurements from refrigerator and freezer units that contain vaccines and other pharmaceuticals.

Until state and federal regulations acknowledge mathematical formulas to replace the glycol-based temperatures, one embodiment uses two temperature measuring devices. The first temperature probe 300*c* reads the temperature within the buffer or mass 300*e* (any liquid or solid having mass) which is slow-changing (not responsive to fast changes in temperature within the refrigeration unit 399) and provides data as required by CDC and state requirements. The ambient air temperature measuring probe 300*d* measures the fast-changing air temperature within the refrigeration unit 399 and provides data that is used to analyze and process compressor cycles, and ultimately, used to model the refrigeration operational characteristics and predict/determine failures.

In another embodiment only one the first temperature probe 300*c* is present. In this embodiment the average temperature is derived from the single sensor, regardless of whether the sensor is in ambient air or submerged in a buffer or mass 300*e* (e.g., glass beads or glycol). It is anticipated that it will be more difficult to detect subtle changes in air temperature when the only sensor is submerged in a buffer or mass 300*e*.

Compressor/refrigeration problems are detected within minutes of a refrigeration fault condition, thereby enabling the responder to correct the problem before the contents of the refrigeration unit 399 are exposed to critical or near-critical temperatures.

Prior systems in existence today operate to generate alerts only when the temperatures have exceeded specified levels for specified periods of time. To minimize false alarms, these levels are generally set to the highest acceptable levels placing the contents of the refrigeration units 399 in danger or near-dangerous conditions before a corrective action is initiated.

In operation, there are at least two conditions in which a compressor-cycle pattern produces non-symmetrical or irregular temperature patterns. One of these conditions occurs when the refrigeration unit 399 is in defrost mode. When in defrost mode, two things occur. The cycle-interval between temperature increases and decreases becomes longer and the rate-of-rise for the air temperature increases significantly during the compressor cycle.

To avoid an invalid alarm generated when the compressor cycle period exceeds the specified value (i.e. 30 minutes). The server analyzes the temperature data between the current temperature reading and the last known validated cycle transaction time. If the rate-of-rise and the peak temperature value from the first temperature probe 300*c* (in buffer or mass 300*e*) is significantly higher than the average temperature from the first temperature probe 300*c* during the period since the last valid compressor cycle transition, it is assumed that either a defrost cycle occurred or the door to the refrigeration unit 399 is open. If it is detected that a significant rate-of-rise in the ambient temperature from the ambient air temperature measuring probe 300*d* (ambient) during the period following the last valid compressor transition time, the delay-until-alarm period is increased by a specified period (i.e. instead of generating an alarm in 30 minutes, waiting 60 or 90 minutes) for the cycle pattern to return to a more frequent, normal state following the end of the defrost cycle, or after the door is closed.

State and federal agencies require or recommend the use of water-filled bottles in both freezers and refrigerators. These bottles of water add mass and will extend the time in which refrigeration units 399 can maintain their temperatures in the event of refrigerator failure or power loss. In many cases, the temperature measuring device probes 300*c*/300*d* are wrongly positioned underneath bags of ice in freezers or surrounded by cold objects in refrigerators and do not indicate temperature problems because their temperature readings are being masked by the surrounding cold objects. The above described system closely monitors the on/off compressor cycling of the refrigeration units 399, detecting a "flat line" reading that occurs when a cold object is placed on or around the sensors 300*c*/300*d* and an alert is generated, indicating that analysis is non-functional due to the ice or other object.

Additionally, when the on/off compressor cycle pattern occurs too frequently, an alert is generated representative of a refrigeration unit 399 not holding sufficient temperature during the "off" cycle of a compressor. Typically, this is caused by a door not being fully closed, a leaky seal, or insufficient mass (i.e. water bottles) within the refrigeration unit 399 (used to retain the temperature for a period of time following a catastrophic power failure or refrigeration hardware failure).

In another embodiment, the above described, temperature zero-crossing detection method is enhanced or substituted with algorithms that process the real-time or stored temperature data.

In another embodiment the above described, temperature zero-crossing detection method is performed within a microcontroller within the temperature measuring device 300, or within the bridge unit 200, or in on-site hardware such as a local computer, or microcontroller-based device.

State and federal health agencies require that health care providers perform routine visual inspections of their temperatures. For example, temperature monitoring devices for vaccines are required to capture and timestamp when a staff views or "inspects" the temperatures. The required interval for checking or inspecting temperatures is typically at least twice daily.

The corrective action data is placed directly on the timeline of a temperature graph. A temperature problem is then associated with the solution. All system information is also displayed on the graph using various icons to display different types of data. The timeline includes, for example, change-log data, corrective action data, temperature alerts, temperature inspections, etc.

In some embodiments, a floor plan or site map is provided, displaying data from multiple temperature measuring devices 300 simultaneously. The floor plan simplifies visual supervision and is used to determine when multiple temperature measuring devices 300 are affected by the same cause such as a particular warm section of a building, an electrical problem or a coolant circuit problem. The floor plan also facilitates fast error-free identification of problem s with temperature measuring devices 300.

In one embodiment the sensors are administratively added through software using drag-and-drop followed by a window interface that collect the sensor's ESN (electronic serial number), name, location, specific settings, etc. In another embodiment the sensor's barcoded ESN is read using a camera 93 of a cell phone 108 or other device/scanner. After scanning the barcoded ESN, the user touches the screen on the mobile device (e.g., cell phone 108) at the location of the floorplan where the device is to be placed. Once placed, the user is prompted to enter the device name and other specific data for that device. This method simplifies the addition devices to a floor plan and reduces errors related to manual entry of serial numbers.

In some embodiments, the temperature measuring devices 300 includes a light sensor 300*g* that is exposed to ambient lighting conditions within the refrigeration unit 399. The light sensor 300*g* measures light around the temperature measuring devices 300 and the ambient light level is used to determine when a door to the refrigeration unit 399 is open, either from light entering the refrigeration unit 399 from outside of the refrigeration unit 399 or from light produced by a light (bulb, LED, etc.) internal to the refrigeration unit 399.

Figure 7:
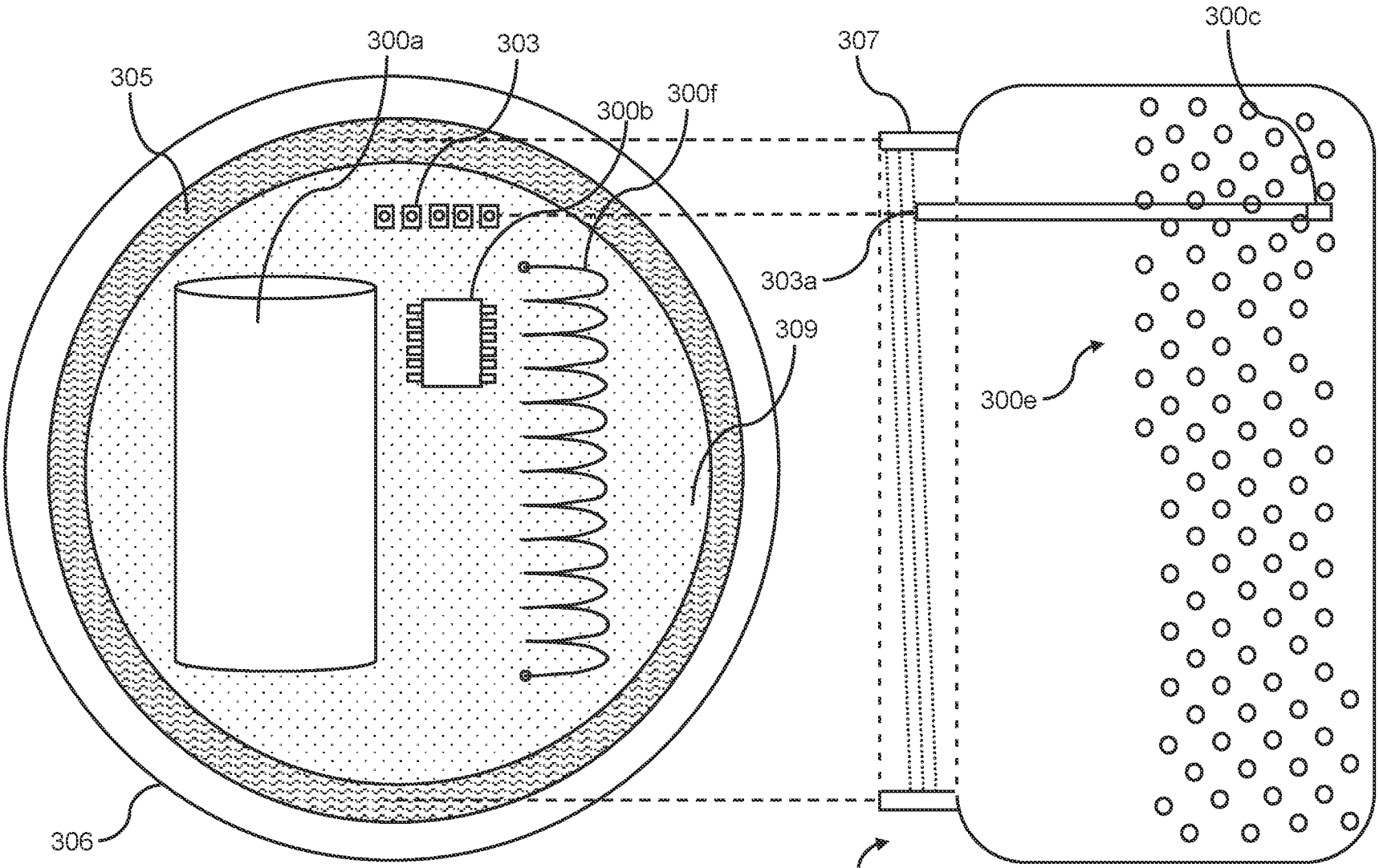
FIG. 7 illustrates a partially exploded view of an embodiment of the temperature sensing device of the system for temperature monitoring and alerting.

As shown in FIG. 7, in some embodiments, the temperature measuring devices 300 are housed in a container 301 in the shape of a bottle. The electronics including the processor 300*b*, the antenna 300*f*, the optional light sensor 300*g* (not visible, on opposite side of circuit board 309), the ambient air temperature measuring probe 300*d* (not visible, on opposite side of circuit board 309) and a battery 300*a* are mounted to a circuit board 309 that is affixed inside of a lid of the container. In this embodiment, the first temperature probe 300*c* is connected to the circuit board 309 and processor 300*b* by a connector pair 303/303*a*. In some embodiments, a gasket 305 seals between the lid 306 and the lip 307 of the container (e.g. jar 304). In this embodiment, the buffer or mass 300*e* comprises a plurality of glass beads.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A system for monitoring and reporting internal refrigeration unit temperatures, the system comprising:

a temperature measuring device for placement within a refrigeration unit, the temperature measuring device housed within an enclosure and having a first temperature sensors situated in a solid or liquid mass for measuring a buffered temperature within the refrigeration unit and the temperature measuring device having a second temperature sensors interfaced to ambient air within the refrigeration unit, the second temperature sensor for measuring an instantaneous temperature within the refrigeration unit;

means for periodically transmitting the buffered temperature and the instantaneous temperature from the temperature measuring device;

means for receiving and analyzing the buffered temperature and the instantaneous temperature located outside of the refrigeration unit;

means for determining and/or predicting a fault, the means for determining and/or predicting the fault located external to the refrigeration unit; and means for sending an alert to a remote device responsive to the fault detected by the means for determining and/or predicting the fault.

2. The system for monitoring and reporting internal refrigeration unit temperatures of claim 1, wherein the means for analyzing comprises computer software that analysis the buffered temperature and the instantaneous temperature and determines an on/off cycling pattern of a compressor of the refrigeration unit.

3. The system for monitoring and reporting internal refrigeration unit temperatures of claim 2 wherein the computer software uses the on/off cycling pattern of the compressor of the refrigeration unit to determine that a door to the refrigeration unit is left open.

4. The system for monitoring and reporting internal refrigeration unit temperatures of claim 2 wherein the computer software uses the on/off cycling pattern of the compressor of the refrigeration unit to determine that a door to the refrigeration unit has remained closed for a period of time, indicating that no inspection has been made.

5. The system for monitoring and reporting internal refrigeration unit temperatures of claim 2, wherein the computer software provides user-accountability by confirming that alert messages have been received and acknowledged at the remote device.

6. The system for monitoring and reporting internal refrigeration unit temperatures of claim 2, wherein the computer software confirms and logs that alerted staff member has responded at the physical location of the system for monitoring and reporting internal refrigeration unit temperatures.

7. The system for monitoring and reporting internal refrigeration unit temperatures of claim 1, wherein the solid or liquid mass is glycol.

8. The system for monitoring and reporting internal refrigeration unit temperatures of claim 1, wherein the solid or liquid mass is a plurality of glass beads.

9. The system for monitoring and reporting internal refrigeration unit temperatures of claim 8, wherein the enclosure comprises a bottle and a lid, the bottle holding the glass beads, the means for receiving and analyzing comprising a processor and the means for sending the alert comprising a transmitter and antenna, the second temperature sensor, the processor, the transmitter, and the antenna located on a circuit board inside of the lid and the first temperature sensor extending from the circuit board to be surrounded by the glass beads when the lid is on the bottle.

10. A system for monitoring and reporting internal refrigeration unit temperatures, the system comprising:

a first temperature sensors situated in a solid or liquid mass for measuring a buffered temperature within a refrigeration unit;

a second temperature sensors exposed to ambient air within the refrigeration unit, the second temperature sensor for measuring an instantaneous temperature within the refrigeration unit;

a transmitter operatively coupled to the first temperature sensor and to the second temperature sensor, the transmitter periodically transmitting the buffered temperature and the instantaneous temperature;

a receiver outside of the refrigeration unit, the receiver adapted to receive and understand the buffered temperature and the instantaneous temperature;

a computing system interfaced to the receiver, the computing system having software that determines and/or predicts a fault with the refrigeration unit by comparing the buffered and the instantaneous temperatures with historical values of the buffered temperature and the instantaneous temperature; and upon determination and/or prediction of the fault, the computing system sends an alert to a remote device indicating the refrigeration unit and fault.

11. The system for monitoring and reporting internal refrigeration unit temperatures of claim 10, wherein the software monitors on/off cycling patterns of a compressor of the refrigeration unit to determine that a door to the refrigeration unit is open.

12. The system for monitoring and reporting internal refrigeration unit temperatures of claim 10, wherein the software monitors on/off cycling patterns of a compressor of the refrigeration unit to determine that a door to the refrigeration unit has remained closed for a period of time, indicating that no inspection of the refrigeration unit has been made.

13. The system for monitoring and reporting internal refrigeration unit temperatures of claim 11, wherein solid or liquid mass is selected from the group consisting of glycol and glass beads.

14. A method for determining and predicting a fault in a refrigeration unit, the method comprising:

obtaining a buffered temperature from a first temperature sensor located in a solid or liquid mass within the refrigeration unit;

obtaining an instantaneous temperature from a second temperature sensor within the refrigeration unit;

determining and/or predicting the fault with the refrigeration unit by comparing the buffered temperature and the instantaneous temperature with historical values of the buffered temperature and the instantaneous temperature; and sending an alert to a remote device responsive to the step of determining and/or predicting the fault after the fault is determined and/or predicted.

15. The method of claim 14, wherein the solid or liquid mass comprises one of glycol and glass beads.

16. The method of claim 14, wherein the second sensor is interfaced to ambient air within the refrigeration unit.

17. The method of claim 14, further comprising a step of determining if a door to the refrigeration unit is open by monitoring on/off cycling patterns of a compressor of the refrigeration unit.

18. The method of claim 17, further comprising a step of emitting an alert message to a user device responsive to determining if the door to the refrigeration unit being open.

19. The method of claim 14, further comprising a step of determining if a door to the refrigeration unit is open by monitoring on/off cycling patterns of a compressor of the refrigeration unit and if the door is not opened within a predetermined amount of time, indicating that no inspection of the refrigeration unit has been made.

* * * * *